United States Patent [19]

Graupe et al.

[11] 4,126,761

[45] Nov. 21, 1978

[54] METHOD OF AND MEANS FOR PROCESSING AN AUDIO FREQUENCY SIGNAL TO CONCEAL INTELLIGILITY

[76] Inventors: Daniel Graupe, 2821 Redwing, Fort Collins, Colo. 80521; David L. Cohn, 52732 Arbor Dr., South Bend, Ind. 46635; G. Donald Causey, 3504 Dunlop, Chevy Chase, Md. 20015

[21] Appl. No.: 767,904

[22] Filed: Feb. 11, 1977

[51] Int. Cl.[2] ..... H04K 1/02

[52] U.S. Cl. ..... 179/1.5 R; 178/22; 325/38 A

[58] Field of Search ..... 179/1.5 R; 178/22; 325/32, 38 A

[56] References Cited

U.S. PATENT DOCUMENTS

| | | | |
|---|---|---|---|
| 3,504,286 | 3/1970 | Jacobaeus | 179/1.5 R |
| 3,536,833 | 10/1970 | Guanella | 178/22 |
| 3,639,690 | 2/1972 | Braun et al. | 178/22 |
| 3,689,699 | 9/1972 | Brenig et al. | 325/38 A |
| 3,746,799 | 7/1973 | Gentges | 179/1.5 R |
| 3,750,021 | 7/1973 | Lender | 325/38 A |
| 3,754,237 | 8/1973 | de Laagede Meux | 325/38 A |
| 3,813,493 | 5/1974 | Hughes et al. | 179/1.5 R |
| 3,959,726 | 5/1976 | Hinoshita et al. | 325/38 A |

FOREIGN PATENT DOCUMENTS

| | | | |
|---|---|---|---|
| 740,512 | 8/1966 | Canada | 179/1.5 R |

*Primary Examiner*—Howard A. Birmiel
*Attorney, Agent, or Firm*—Donald M. Sandler

[57] ABSTRACT

An input audio frequency analog signal, for example, speech, which is to be passed through a noisy transmission channel, is scrambled at the sending end by repetitively performing a modulo-$v$ (MOD $v$) addition of an $n$-level, $m$-pulse codeword with an $n$-level digitized transformation of the input signal under the condition that $m$ and $v$ are integers. The resultant sum signal, after transmission through a noisy channel (which may be an acoustic medium, a conventional telephone link, a conventional CB radio link, etc.), is received at the receiving end and descrambled. Descrambling is achieved by carrying out a Mod $v$ subtraction process involving repetitively subtracting the same codeword from an $n$-level digitized transformation of the received signal, the subtraction being carried out in synchronism with the addition at the sending end. The resultant difference signal is a representation of the input signal and is relatively insensitive to noise present in the transmission channel.

22 Claims, 5 Drawing Figures

METHOD OF AND MEANS FOR PROCESSING AN AUDIO FREQUENCY SIGNAL TO CONCEAL INTELLIGILITY

BACKGROUND OF THE INVENTION

This invention relates to a method and means for processing an input digital signal, and more particularly to a processing operation by which the signal is scrambled for transmission through a noisy communication channel.

U.S. Patent application Ser. No. 724,170 filed Sept. 17, 1976, in the names of Daniel Graupe et al, (which is hereby incorporated by reference), discloses a method of and means for scrambling an input speech signal that is to be transmitted through a communication channel, and for descrambling the received signal to obtain a representation of the input signal. In such application, an $n$-level digitizing of the input signal is performed at the sending end allowing transformation of the levels of the digitized signal to other levels using a preselected transformation code whereby the transformed signal is a scrambled version of the input signal. The transformed signal can be transmitted through a communication channel such as an acoustic medium, a telephone link, a CB radio link, etc. At the receiving end of the channel, an $n$-level digitization of the received signal is performed followed by an inverse transform of the levels of the digitized signal using the inverse of the preselected transformation code applied to the digitized input signal. The inversely transformed signal is then converted into an analog signal which is representative of the input signal.

Where the transmission channel contains significant noise, which is added to the transmitted signal during its transmission, the received signal may differ significantly from the transmitted signal with the result that the inverse transformation yields a representation of the input signal that is degraded in proportion to the amount of noise in the channel.

It is therefore an object of the present invention to provide a new and improved technique for processing an audio-frequency signal to permit scrambled transmission through a noisy communication channel, while allowing for recovery of a reasonable representation of the original audio-frequency signal.

SUMMARY OF THE INVENTION

In accordance with the present invention, an input audio-frequency signal, such as speech, for example, which is to be passed through a noisy transmission channel, is scrambled at the sending end by repetitively performing a modulo-$v$ (MOD $v$) addition of an $n$-level, $m$-pulse codeword with an $n$-level digitized transformation of the input signal where $m$ and $v$ are integers, each of which is preferably, but not necessarily, greater than $n-1$. The resultant sum signal, after transmission through a noisy communication channel, which can be an acoustic medium, a telephone link or a CB radio link, etc., is received at the receiving end where a Mod $v$ subtraction process is carried out on the received signal by repetitively subtracting the same codeword from an $n$-level digitized transformation of the received signal, the subtraction being carried out in synchronism with the addition at the sending end. Synchronization is achieved by providing for the codeword to be shifted, at the receiving end, forwardly or backwardly, by an appropriate number of discretization intervals until intelligibility is achieved. Thus, synchronization is achieved by relying on the contents of the received signal without direct knowledge of the phase of the codeword at the sending end. The difference signal resulting from the synchronized subtraction is a representation of the input signal, and is relatively insensitive to noise.

The addition of the codeword at the sending end scrambles the signal in the transmission channel. The addition of noise to the signal in the transmission channel is taken into account by the synchronous subtraction of the codeword from the received signal thereby descrambling the same and reducing significantly the effect of noise in the transmission channel.

The invention also consists in apparatus for processing an audio-frequency signal in accordance with the method described above.

BRIEF DESCRIPTION OF THE DRAWINGS

An embodiment of the present invention is disclosed in the accompanying drawings wherein.

DETAILED DESCRIPTION

Figure 1:
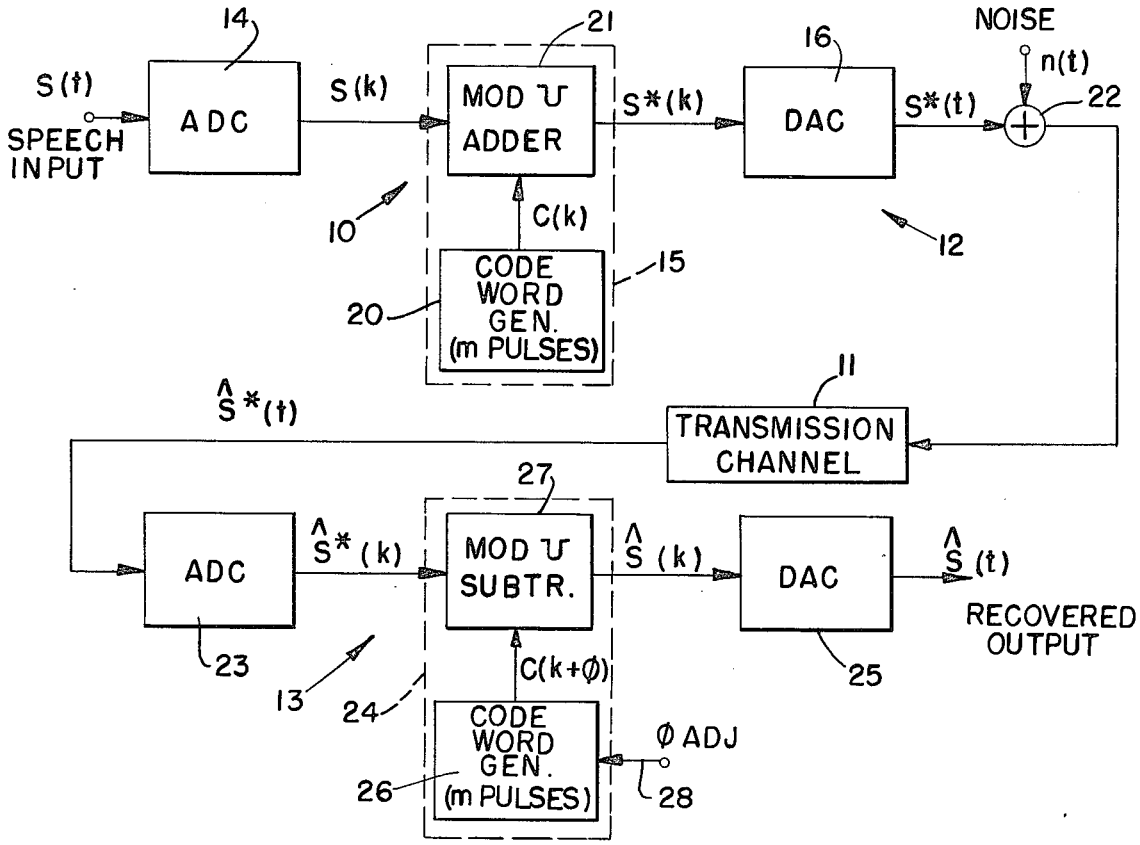
FIG. 1 is a block diagram of apparatus according to the present invention.

Referring now to FIG. 1, reference numeral 10 designates apparatus according to the present invention for processing an input audio-frequency signal in the form of speech which is to pass, scrambled through a noisy transmission channel 11. Apparatus 10 includes scrambler means 12 at the sending end, and descrambler means 13 at the receiving end.

Scrambler means 12 includes an analog-to-digital (ADC) converter 14, transformation circuit 15, and a digital-to-analog converter (DAC) 16. Converter 14 performs an $n$-level digitization of the input analog signal $S(t)$ for obtaining digitized signal $S^*(k)$. The term "$n$-level digitization" means an analog-to-digital conversion in which the input signal $S(t)$ is sampled at a frequency at least twice the highest frequency to be transmitted for obtaining a train of pulses with amplitude scaled to $n$-levels.

Figure 2:
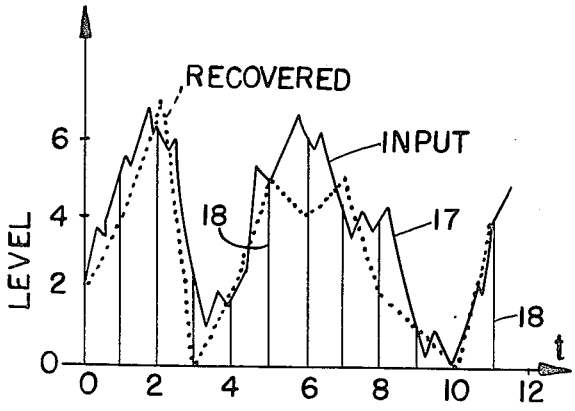
FIG. 2 is a graph showing a typical time-variable input audio-frequency signal showing an eight level range of amplitude, and showing an eight level digitized transformation of the input signal superimposed thereon, the recovered signal at the receiving end being superimposed for comparison with the input signal.
Figure 3:
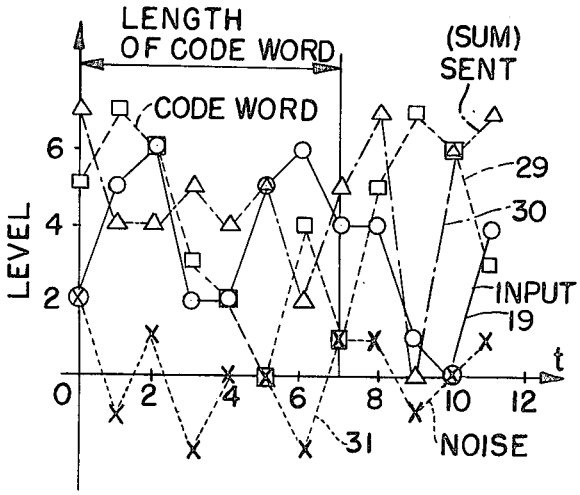
FIG. 3 shows a digitized transformation of the input signal, and the result of a Mod 8 addition of a preselected codeword to obtain a digitized sum signal, a typical noise signal being shown and representing the noise added to the transmitted signal in the transmission channel.

FIG. 2 shows a typical speech input signal, indicated by reference numeral 17, divided into eight levels (0–7) with one of the eight possible levels being assigned to the speech signal each time the signal is sampled. The result of the eight level digitization is indicated by lines 18 representing a train of pulses of the amplitude indicated occurring at the times indicated. Since the sampling frequency is fixed, the pulses 18 produced by ADC 14 will have a preselected repetition frequency, and amplitudes which will vary with time as indicated in FIG. 3 by the solid line curve 19 interconnecting the circles which represent the amplitudes of the pulses at the sampling times indicated. It should be understood that curve 19 is provided for the purpose of facilitating showing how the amplitudes of the pulses vary with time. The sampling frequency is preferably smaller than or equal to twice the maximum channel frequency, but larger than or equal to twice the maximum frequency of the signal to be passed in order to avoid loss of information due to sampling.

Transformation circuit 15 comprises codeword generator 20 and modulo $v$ adder 21. Generator 20 repetitively generates an $n$-level train of pulses at the same repetition frequency as the pulses produced by ADC 14, there being $m$-pulses in each word, each pulse occurring simultaneously with the sampling of signal 17 by ADC 14. The codeword is thus a group of $m$-pulses, each of which can have $n$-levels of digitization where $m$ is an integer and, preferably, but not necessarily, is greater than $n-1$. The output of generator 20, i.e., repetitive codewords, is designated $C(k)$ and is applied together with the digitized transformation of the input signal, $S^*(k)$, to the Mod $v$ adder 21 where $v$ is an integer and has a value greater than $n-1$. Adder 21 performs the following operation:

$$S^*(k) = [S(k) + C(k)]\text{Mod } v \tag{1}$$

The output of adder 21 is the digitized sum signal $S^*(k)$. As will be apparent from the example described below, the signal $S^*(k)$ is a scrambled version of the original input signal.

Finally, DAC 16 of scrambler means 12 operates on the digitized sum signal $S^*(k)$ to convert the same into an analog sent signal $S^*(k)$ which forms a scrambled version of the input signal and is available for transmission through channel 11 which can be an acoustic medium (i.e., a medium that transmits sound), a conventional telephone link or an RF link such as a CB channel. In such case, DAC 16 would include a speaker (not shown) whose output is transmitted through air, (for example, via proximity locating) to a microphone that is a part of a loud speaker system or to the input side of a conventional telephone, or to the microphone of a conventional radio transmitter. Transmission channel 11 thus passes $S^*(t)$ either as an audio acoustic signal developed by a loud speaker and passing through an acoustic medium, or as an electrical audio-frequency signal passing through a conventional telephone line, or as an RF carrier modulated by an audio-frequency signal passing between CB or other radio stations.

When the transmission channel is noisy, increments of random amplitude will be added to the signal being transmitted through the channel. Thus, the signal received by the descrambling means 13 at the receiving end of the system will be different from the sent signal entering the transmission channel. The received signal is designated $\hat{S}^*(t)$ and differs from $S^*(t)$ by reason of the noise added in the transmission channel. This addition of noise is indicated schematically in FIG. 1 by adder 22 to which the analog sent signal $S^*(t)$ and the noise signal $n(t)$ are applied. Thus, adder 20 performs the operation:

$$\hat{S}^*(t) = S^*(t) + n(t). \tag{2}$$

Descrambler means 13 comprises ADC 23, inverse transformation circuit 24 and DAC 25. ADC 23 performs, on signal $\hat{S}^*(t)$, the same digitization process carried out by ADC 14 on the original input signal $S(t)$. That is to say, an $n$-level digitization is performed yielding a digitized received signal $\hat{S}^*(k)$ which will differ from the sum signal $S^*(k)$ produced at the output of transformation circuit 15 in scrambler means 12. The difference will be caused by the noise present in transmission channel 11.

Circuit 24 comprises a codeword generator 26 similar to generator 20 of the scrambler means 12 and Mod $v$ subtractor 27. The pulse train produced by generator 26 has the same pulse repetition frequency as generator 20. To provide synchronization between the pulse train produced by generator 26 and the pulse train produced by generator 20, generator 26 is provided with adjustment 28 which permits the time relationship of the pulses produced by generator 26 to be shifted relative to the instants at which sampling occurs during the operation of ADC 14. Adjustment 28 provides for shifting the entire codeword over a period of time required to provide $m$-pulses. Since the sampling frequency will be at a relatively high rate, the phase difference between the instant of sampling in ADC 23 and the instant of sampling in ADC 14 will be of little consequence. Essentially, it is assumed that ADC 21 samples at the same instant that ADC 14 samples, although it should be understood that there is likely to be some small phase difference.

In order to indicate that the pulse train produced by generator 26 can be shifted with respect to the pulse train produced by generator 20, the output of generator 26 is designated $C(k + \phi)$. This output is applied to Mod $v$ subtractor 27 of inverse transformation circuit 24 as indicated in the drawing. Subtractor 27 performs a Mod $v$ subtraction of the digitized received signal and the output of generator 24. In this regard, it should be noted that the adjustment 28 of generator 24 is such that the timewise shift in the pulses produced by the generator occur in discreet increments matching the period of the pulses produced by the generator. Mathematically speaking, subtractor 27 performs one or the other of the following two operations:

$$\hat{S}(k) = [\hat{S}^*(k) - C(k+\phi)]\text{Mod } v \tag{3A}$$

$$\hat{S}(k) = [C(k+\phi) - \hat{S}^*(k)]\text{Mod } v \tag{3B}$$

The output of inverse transformation circuit 24 is a digitized difference signal $\hat{S}(k)$ which is applied to DAC 25 which converts the digitized difference signal into analog form thereby reproducing a recovered analog signal that is a representation of the input audio-frequency signal applied to ADC 14.

The chart shown below is an example for $n = m = v = 8$.

CHART

| SAMPLE TIME | 0 | 1 | 2 | 3 | 4 | 5 | 6 | 7 | 8 | 9 | 10 | 11 | — | — |
|---|---|---|---|---|---|---|---|---|---|---|---|---|---|---|
| S(k) | 2 | 5 | 6 | 2 | 2 | 5 | 6 | 5 | 5 | 1 | 0 | 4 | — | — |
| C(k) | 5 | 7 | 6 | 3 | 2 | 0 | 4 | 1 | 5 | 7 | 6 | 3 | 2 | ... |
| S*(k) | 7 | 4 | 4 | 5 | 4 | 5 | 2 | 5 | 7 | 0 | 6 | 7 | — | — |

CHART-continued

| SAMPLE TIME | 0 | 1 | 2 | 3 | 4 | 5 | 6 | 7 | 8 | 9 | 10 | 11 | — | — |
|---|---|---|---|---|---|---|---|---|---|---|---|---|---|---|
| n(k) | 2 | −1 | 1 | −2 | 0 | 0 | −2 | 1 | 1 | −1 | 0 | 1 | — | — |
| $\hat{S}^*(k)$ | 7 | 3 | 5 | 3 | 4 | 5 | 0 | 6 | 7 | 0 | 6 | 0 | — | — |
| C(k) | 5 | 7 | 6 | 3 | 2 | 0 | 4 | 1 | 5 | 7 | 6 | 3 | 2 | — |
| $\hat{S}(k)$ | 2 | 4 | 7 | 0 | 2 | 5 | 4 | 5 | 2 | 1 | 0 | 5 | — | — |

Note that when S*(k) has a maximum value (i.e., a value of 7 in the above example), addition of a positive value of n(k) cannot take place. Similarly, when S*(k) has a minimum value, addition of a negative value of n(k) cannot take place.

The time variation in amplitude of the pulse train produced by generator 20 as well as generator 26 is shown in FIG. 3 by the squares interconnected by the broken line designated by reference numeral 29 which facilitates illustration of the manner in which the amplitude changes with time. Note that the amplitude of the pulse that appears at the output of generator 20 at the eighth sampling incident is the same as the amplitude of the pulse that appears at the first sampling incident, the amplitude of this pulse having the value 5. It should be noted that the particular codeword is entirely arbitrary and the one shown is only illustrative.

As indicated in the above chart, adder 21 performs a Mod 8 addition. For example, at sampling time $t=1$, the amplitude of the digitized input signal will have a value 5 while the amplitude of the code word pulse will have value 7. The Mod 8 addition of these two amplitudes will yield a pulse of value 4 in a known manner.

The time variation in amplitude of the sum signal $S^*(k)$ is shown by the triangles in FIG. 3, curve 30 interconnecting the triangles facilitation illustration of the timewise variation in the pulses that are applied to DAC 16. As can be seen from inspection, curve 30 is significantly different from curve 19 and represents a scrambled version of the input audio-frequency signal. By reason of the noise present in transmission channel 11, the amplitude of the received signal will differ from the amplitude of the sent signal $S^*(k)$. Assuming the noise has a timewise variation indicated in FIG. 3, where the crosses represent the amplitude of the noise present in channel 11 at the sampling instants, curve 31 facilitates illustration of the timewise variation in noise. It should be noted that the noise will have an average value of zero, and the values shown in FIG. 3 are illustrative since the noise will probably be random.

Figure 4:
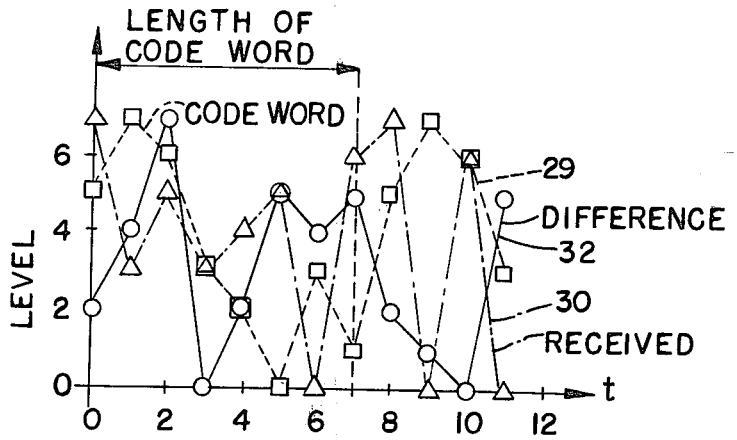
FIG. 4 shows the result of a synchronized Mod 8 subtraction process between the received signal containing noise, and the codeword for obtaining the recovered signal.

After the received signal is transformed by ADC 23 into a digitized received signal, the time variation in the amplitude of the pulse train produced by ADC 23 will be as indicated by the triangles shown in FIG. 4, curve 32 interconnecting these triangles being provided to illustrate the timewise variation in the received digitized signal. Note the difference between curve 32, which is the received signal, and curve 30 which is the sent or transmitted signal. The difference is due to the presence of noise in transmission channel 11. It should be noted that the transmission channel limits the amplitude of the signal. Thus, at time $t=0$ where the amplitude of the modified analog input signal has a value 7 and the noise has a value 2, the value 7 which is the maximum value that the signal can have. Thus, the presence of noise of a positive amplitude at this instant has no effect on the signal level.

Subtractor 27 may carry out the operation indicated by equation 3A above and the result is shown in the last line of the above chart. In FIG. 4, the timewise variation and amplitude of the codeword is shown by the squares with curve 29 interconnecting the squares for facilitating illustration of the timewise variation in the codeword. Note that curve 29 in FIG. 4 is the same as curve 29 in FIG. 3, it being assumed that adjustment 28 has been operated such that the two generators 20 and 26 are synchronized in their operation. The Mod 8 subtraction carried out by subtractor 27 produces a pulse train whose amplitude varies in time in the manner shown by the circles in FIG. 4. The solid line 32 interconnecting the circles facilitates illustration of the timewise variation in the recovered signal. For comparison purposes, curve 32 is also shown in FIG. 2. As can be seen, there has been some degradation by reason of the computation and the noise, but the shapes of curves 17 and 31 are quite similar. However, the maximum level of error is not more than the maximum noise amplitude which would have been present without the processing. Therefore, the processing of the present invention does not degrade intelligence more than it would have been degraded by noise in the absence of such processing.

In actual practice, synchronization between the generators 20 and 26 is achieved by operating adjustment 28 until the intelligibility of the recovered output is maximized. Note that the adjustment 28 permits the codeword to be shifted forwardly and backwardly in time with respect to the sampling instants.

The operation of adder 21 and subtractor 27 can be carried out in other moduli bearing in mind the constraint that both $m$ (i.e., the number of pulses in the codeword) and $v$ (i.e., the modulus) are both integers and must be greater than $n-1$ where $n$ is the number of levels of digitization. For example, conventional addition and subtraction can be carried out. If ordinary arithmetic addition and subtraction is designated as Mod $\infty$, then 2 $n$-levels of signal value will be transmitted and received whereas the input speech will be limited by a limitor to $n$-levels.

The apparatus and method according to the present invention work best when significant channel noise is present. They also provide an inherent scrambling operation although in the output of DAC 16, the input signal is actually present. When the channel noise is less significant, it may be advantageous to utilize the scrambling technique in Patent application Ser. No. 724,170 referred to above. In such case, it may be helpful to provide a switch for switching from the mode of operation described in the above-identified patent application, when there is a low level present in the transmission channel and scrambling is required, to the technique of the present invention when the noise level is significantly high.

There are many possible ways to carry out the signal processing described above. For example, micro-electronic logic means, or a microprocessor could be employed. The codeword could be selected from a repetoir of possible words, as for example, using a matrix of switches. Alternatively, a tape and tape reader could be used wherein the tape or card could contain one or more codes that would be selected by the user of apparatus 10. Obviously, the user of descrambler means 13 would have to know the code being used before descrambling can take place to recover the original signal.

Figure 5:
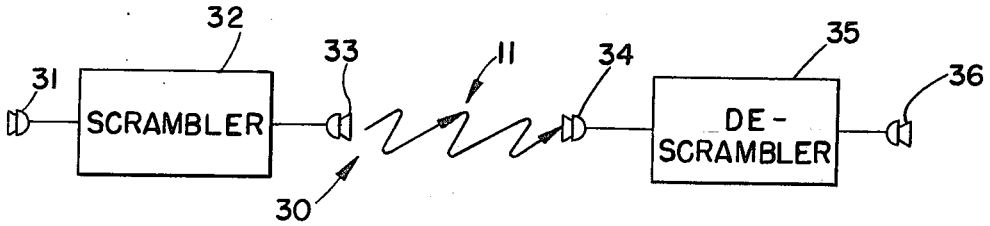
FIG. 5 is a block diagram of one form of the invention.

FIG. 5 shows a simple secure communication system 30 by which the speech of one person talking into microphone 31 could be understood by another person only if the latter had access to loudspeaker 36. The speech would be scrambled in scrambler means 32 using the techniques described above according to the selected code. The output of speaker 33 would contain practically all the intelligence in the speech, but it would be concealed and not available to a person listening to the output of speaker 33.

After transmission via air, telephone line or radio, the scrambled speech would be received by the second person's microphone 34. If the latter sets into descrambler means 35, the same code selected by the first person, means 35 will properly descramble the scrambled speech and essentially the same sound at microphone 31 will be reproduced by speaker 36. The reverse process could take place from the second to the first person. Thus, the present invention permits two-way secure voice transmission to take place.

Means 34, 35 and 36 may be incorporated, advantageously, into a device like a hearing-aid that can be donned and removed easily. When the person at each end of a conventional telephone line wears a device of this nature, and when each person interposes a unit comprising means 31, 32 and 33 between his mouth and the input end of a conventional telephone, the transmission over the telephone line will be unintelligible to anyone listening on the line without a device like means 34, 35 and 36 set with the proper transformation code.

Alternatively, if each person speaking via a CB link interposed means 31, 32 and 33 between his mouth and his CB microphone, the radio transmission would be intelligible only to a listener wearing a hearin-aid int which means 34, 35 and 36 are incorporated and set with the proper transformation code.

It is believed that the advantages and improved results furnished by the apparatus and method of the present invention are apparent from the foregoing description of the preferred embodiment of the invention. Various changes and modifications may be made without departing from the spirit and scope of the invention sought to be defined in the claims that follow.

We claim:

1. A method of processing an input audiofrequency signal for scrambled transmission through a noisy communication channel and for recovering a representation of such signal comprising:

(a) repetitively performing a Mod $v$ addition of an $n$-level, $m$-pulse codeword to an $n$-level digitized transformation of the input audio-frequency signal under the condition that $n>2$, and $m$ and $v$ are integers for obtaining a sum signal;

(b) transmitting the sum signal through the communication channel;

(c) receiving the transmitted signal;

(d) repetitively performing a Mod $v$ subtraction of an $n$-level digitized transformation of the received signal and the same codeword for obtaining a difference digitized signal, the subtraction process being carried out in a selected time relationship to the addition process; and (e) converting the difference digitized signal into analog form for obtaining a representation of the input audio frequency signal.

2. The method according to claim 1 wherein the selected time relationship between the addition and subtraction process is adjustable.

3. The method according to claim 2 wherein $v=n$.

4. A method according to claim 2 wherein $m=n$.

5. A method according to claim 2 wherein $m=v=n$.

6. Apparatus for processing an input audiofrequency signal for scrambled transmission through a noisy communication channel and for recovering a representation of such signal comprising:

(a) means at the sending end of the channel including:

(1) means for performing an $n$-level digitization of the input signal for obtaining a digitized input signal having a given pulse repetition frequency; where $n>2$ (2) means for repetitively generating an $n$-level codeword in the form of a train of $m$-pulses at said given pulse repetition frequency;

(3) means for performing a Mod $v$ addition of the codeword and the digitized input signal for obtaining a digitized sum signal;

(4) means for converting the digitized sum signal into analog form for obtaining an analog sum signal; and (5) means for transmitting the analog sum signal through the communication channel;

(b) means at the receiving end of the communication channel for receiving the transmitted signal.

7. Apparatus according to claim 6 wherein the means at the receiving end of the communication channel includes:

(a) means for receiving the transmitted signal and converting it into a received signal;

(b) means for performing an $n$-level digitization of the received signal for obtaining a digitized received signal having said given pulse repetition frequency;

(c) means for repetitively generating said codeword in a selected time relationship to its generation at the sending end;

(d) means for performing a Mod $v$ subtraction of the digitized received signal and the codeword for obtaining a digitized difference signal; and (e) means for converting the digitized difference signal into analog form for obtaining a representation of the input audio-frequency signal.

8. Apparatus according to claim 7 wherein the means for repetitively generating said codeword includes means for adjusting the time relationship of the generation of said codeword at the receiving end with the generation of said word at the sending end.

9. Apparatus according to claim 8 wherein $v=n$.

10. Apparatus according to claim 8 wherein $m=n$.

11. Apparatus according to claim 7 including a first microphone for receiving the input signal and applying it to said means at the sending end, and wherein said means for transmitting the analog signal is a first speaker, and said means for receiving the transmitted signal is a second microphone, and said means for converting the digitized difference signal into analog form is a second speaker.

12. Apparatus according to claim 11 wherein said means at the receiving end is part of a hearing-aid.

13. Apparatus according to claim 11 including a telephone system for interconnecting the first speaker with the second microphone.

14. Apparatus according to claim 11 including a CB radio link for interconnecting the first speaker with the second microphone.

15. Apparatus according to claim 11 including a loudspeaker to serve as the first speaker for sound communication with the second microphone.

16. Apparatus according to claim 11 including microprocessors.

17. Apparatus according to claim 11 where each of the scrambler and descrambler inlcude switch means whose state determines the codeword used for scrambling and descrambling.

18. Apparatus according to claim 11 including a separate tape containing at least a pre-selected codeword, and a separate tape reader responsive to the tape for establishing the codeword being used.

19. Apparatus according to claim 6 including microelectronic analog-to-digital converter hardware.

20. Apparatus according to claim 7 including microelectronic digital-to-analog converter hardware.

21. In a method for processing an intelligence bearing input audio-frequency signal comprising the steps of scrambling transmission at the sending end by repetitively performing a mod $v$ addition of an $n$-level, $m$-pulse codeword to an $n$-level digitized transformation of the input audiofrequency signal under the condition that $m$ and $v$ are integers for obtaining a sum signal; unscrambling a received signal at the receiving end by repetitively performing a mod $v$ subtraction of an $n$-level digitized transformation of the received signal and the same codeword for obtaining a difference digitized signal, the subtraction process being carried out in a selected time relationship to the addition process; and converting the difference digitized signal into analog form for obtaining a representation of the input audio frequency signal; the improvement comprising shifting the time of the subtraction process independently of the time of the addition process so as to maximize intelligibility of the representation of the input signal, and where $n>2$.

22. The invention of claim 21 wherein the intelligence bearing input audio frequency signal is speech and the shift in said selected time relationship is such as to maximize intelligibility of the speech.

* * * * *